United States Patent [19]

Lempa

[11] 4,192,642

[45] Mar. 11, 1980

[54] UNIVERSAL PILOT ASSEMBLY

[75] Inventor: Roman F. Lempa, Philadelphia, Pa.

[73] Assignee: Selas Corporation of America, Dresher, Pa.

[21] Appl. No.: 897,209

[22] Filed: Apr. 17, 1978

[51] Int. Cl.[2] ..... F23Q 7/06

[52] U.S. Cl. ..... 431/263; 431/266

[58] Field of Search ..... 431/3, 13, 263, 264, 431/266, 278, 79; 239/175, 285, 553.3, 558

[56] References Cited

U.S. PATENT DOCUMENTS

| | | | |
|---|---|---|---|
| 974,040 | 10/1910 | Donley | 239/558 |
| 2,073,448 | 3/1937 | Fruth et al. | 431/285 |
| 2,382,151 | 8/1945 | Harper, Jr. | 239/558 |
| 2,777,512 | 1/1957 | Johnson et al. | 431/263 |
| 2,814,339 | 11/1957 | Aubert | 431/285 |
| 2,864,234 | 12/1958 | Seglem et al. | 431/266 |
| 2,905,236 | 9/1959 | Wright | 431/263 |
| 2,966,943 | 1/1961 | Breese | 431/263 |
| 3,073,121 | 1/1963 | Baker et al. | 431/266 |
| 3,265,114 | 8/1966 | Childree | 431/263 |
| 3,304,988 | 2/1967 | Rackley | 431/263 |

FOREIGN PATENT DOCUMENTS

| | | | |
|---|---|---|---|
| 160799 | 10/1957 | Sweden | 431/266 |

*Primary Examiner*—Carroll B. Dority, Jr.
*Assistant Examiner*—Jerry Anderson
*Attorney, Agent, or Firm*—Miller & Prestia

[57] ABSTRACT

A pilot assembly for a furnace burner includes a housing having a first port capable of mating with a flame detector which can monitor the pilot or main flame of the furnace burner. The housing further includes an air-fuel mixture inlet port coaxially disposed with respect to a second port, which serves the purpose of mating with a spark ignition means. The axes of the fuel mixture inlet port and second port are substantially perpendicular to the axis of the first port. The second port is adapted such that any portion of the spark ignition means extending through the second port and into the housing will not interfere with the monitoring performed by the flame detector means. The housing further includes a third port which can accommodate means for visually sighting the pilot flame. The third port can also serve the purpose of providing manual ignition of the pilot burner.

24 Claims, 4 Drawing Figures

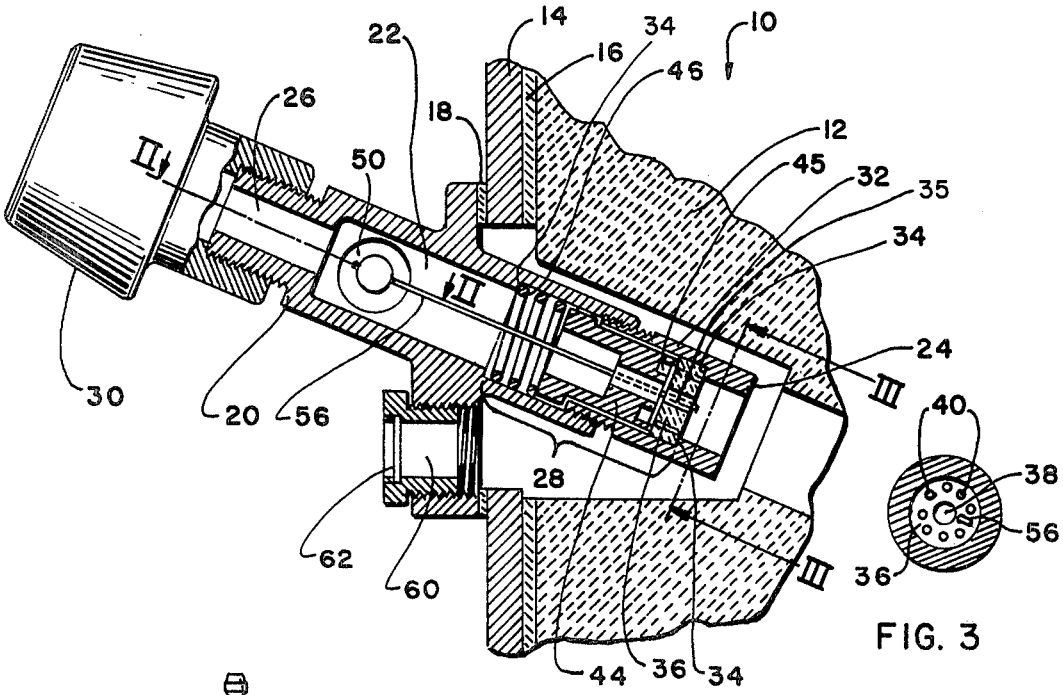
FIG. 3
FIG. 1
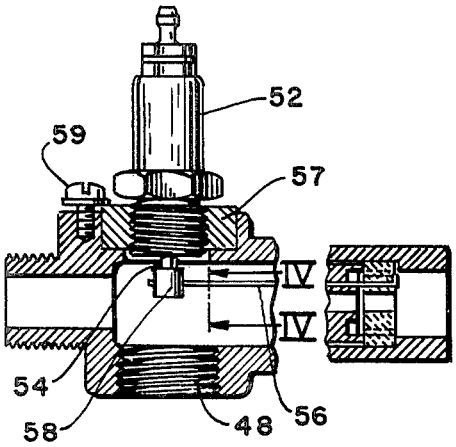
FIG. 2
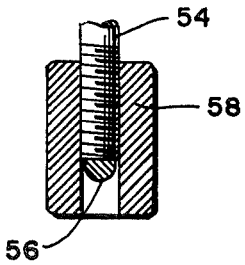
FIG. 4

UNIVERSAL PILOT ASSEMBLY

BACKGROUND OF THE INVENTION

The present invention relates to a pilot frame assembly for a furnace and more specifically to a pilot flame assembly having a housing which provides for accommodating a flame detector means, spark ignition means, manual ignition means, and the entry of the desired air-fuel mixture.

In industrial furnaces, pilot flame assemblies are utilized typically for igniting the main burner flame, which is usually swirling about the cup radiant portion of the burner block. It is most important that some type of monitoring, either by instruments or by visual sighting, be performed on the pilot flame. Those in the past have designed pilot flame assemblies which could provide such detection along with providing the spark for ignition and ports for the fresh air and gas entry into the burner separately, usually requiring multiple cavities, no common cavity, and devices to accommodate all of these functions. Usually the flame detector provides detection either by visual means or by instruments.

However, many of these pilot flame assemblies have been quite complicated and cumbersome, such as disclosed in U.S. Pat. No. 3,324,926 to, Jakobi. It would be most desirable, in the utilization of industrial furnaces, if a pilot flame assembly could provide the functions stated above and the option of both visually detecting, or instrument detecting the pilot flame without being overly cumbersome and complicated.

The object of the present invention is to provide such ignition and detecting options in a pilot flame assembly, while still maintaining a rather simplified device.

SUMMARY OF THE INVENTION

A pilot flame assembly includes a housing having a central passageway extending longitudinally through the housing. A pilot flame emitting end is at one end of the central passageway. A first port for accommodating a flame detection means is at an end of the central passage opposite the pilot flame emitting end. The opening of the first port is in communication with the central passageway in a substantially coaxial relationship. A baffle assembly is within the central passageway of the housing and is coaxially disposed with respect to the first port. The baffle assembly is in proximity to the first flame emitting end of the housing. An inlet port for accommodating a fuel-air mixture is also included in the housing. A second port for accommodating a spark ignition means is also included in the housing. Each of the axes of the inlet port and the second port are substantially perpendicular to the axis of the second port and baffle assembly. The openings of the second port and inlet port communicate in a substantially perpendicular relationship with the central passageway. A third port for accommodating means capable of viewing the pilot flame is also included in the housing. The third port is disposed below the first port, and the opening of the third port has an axis which is at an angle with respect to the axis of the central passageway.

BRIEF DESCRIPTION OF THE DRAWINGS

FIG. 1 is a cross sectional view of the pilot flame assembly of the present invention.

FIG. 2 is a top perspective view of the pilot flame assembly of FIG. 1.

FIG. 3 is a view of FIG. 1 taken along the plane designated by the Roman numerals III—III.

FIG. 4 is an enlarged view along the plane IV—IV of the circled portion of FIG. 2.

DETAILED DESCRIPTION OF THE DRAWINGS

Referring to the drawings, the pilot flame assembly of the present invention is designated as 10. The pilot flame assembly 10 is adapted to be mounted into a cavity of a refractory furnace block 12. As shown in FIG. 1 a metallic cover plate 14 is mounted to the refractory furnace block 12 by conventional means with a gasket 16 between the refractory furnace block wall and metallic cover plate 14. The pilot flame assembly 10 is in turn mounted to the metallic cover plate 14 and refractory furnace block 12 by conventional fastening means (for example bolts, not shown) with a gasket 18 extending between the metallic cover plate 14 and the attached portion of the pilot flame assembly 10.

The pilot flame assembly 10 includes a housing 20, typically of a cast metal. The housing 20 includes a central passageway 22, extending longitudinally through the housing 20. The central passageway 22 terminates at one end of the housing 20 which is designated as the pilot flame emitting end 24. The housing 20 further includes a first port 26 at an end of the housing 20 opposite the pilot flame emitting end 24. The central passageway 22 terminates at its other end at the first port 26. The outside surface of the first port 26 is typically threaded so as to more readily accommodate a flame detection meams 30. The flame detection means 30 may be of any conventional type, such as a ultraviolet radiation semiconductor photodiode.

A portion of the housing 20 at the pilot flame emitting end 24 is designated as housing element 32 and is, of course, hollow and tubular in shape and is screwably mounted to the remaining portion of the housing 20. The purpose for having the housing element 32 screwably mounted to the remainder of the housing 20 will be apparent from the following explanation of the present invention.

Around the inside of the housing 20 and extending into the central passageway 22 are a pair of spaced-apart shoulders 34. The spaced-apart shoulders 34 are in close proximity to the pilot flame emitting end 24 of the housing 20. Preferably, one of the shoulders 34 is in the end housing element 32 while the other shoulder is in the remaining portion of the housing 20.

A baffle assembly 28 disposed in the central passageway 22 extends between and is adjacent to the pair of spaced-apart shoulders 34, i.e., the baffle assembly is in the proximity of the pilot flame emitting end 24. The baffle assembly 28 includes a disk-like screen element 36 substantially adjacent one of the shoulders 34 closest to the pilot flame emitting end 24. The disk-like screen element 36 is typicaly of a ceramic material having central opening 38 and a plurality of spaced-apart openings 40 in the vicinity of the periphery of the disk-like screen element 36. The plurality of spaced-apart openings 40 form a generally circular-like pattern as shown in FIG. 3. An intermediate opening 35 is in said disk-like screen element 36 and is spaced between the central opening 38 and one or more of the spaced-apart openings 40.

Adjacent the disk-like screen element 36 and extending upward through the central passageway 22 is intermediate element 44. Intermediate element 44 is generally cylindrical and hollow in shape, and of a ceramic material. An annular cavity 45 is recessed in the end of the intermediate element 44 which abuts the disk-like screen element 36. The outer wall of the recessed cavity 45, i.e., the wall closest the housing element 32, extends farther than the inner wall so that the inner wall does not touch the disk-like screen element 36 when the outer wall abuts the disk-like screen element 36. This stand-off space at the inner wall creates a flow path from the central passageway 22 to a plenum generated by the annular recessed cavity 45. This flow path allows the air-fuel mixture to pass at a control rate and be uniformly distributed to the spaced-apart openings 40.

The final element of the baffle assembly 28 is a spring 46 which is adjacent to and between the intermediate element 44 and the shoulder of the pair of spaced-apart shoulders 34 farthest from the pilot flame emitting end 24. As is apparent, the spring 46 exerts a force on the intermediate element 44 which in turn, exerts a force on the disk-like screen element 36, thereby maintaining it at its proper position. The spring 46 thus maintains contact between intermediate element 44 and disk-like screen element 36 thereby assuring integrity of the flow path defined by the off-set configuration of the annular recessed cavity 45. Therefore, differential expansion which may occur between the spaced-apart shoulders 34, which are of metal and elements 36 and 44 which are of ceramic materials, upon exposure to high temperatures, will not cause an opening or closing of the gap between the inner wall of the annular cavity 45 and the element 36, because the spring 46 exerts a force on element 44 assuring its contact to element 36. As is readily apparent to one skilled in the art it is of course advantageous to maintain this gap at a relatively constant distance. It is also apparent that the end housing portion 32 is screwably mounted to the remaining portion of the housing 20, so that the baffle assembly 28 can be readily disposed within the central passageway 22.

The opening of the first port 26 and baffle assembly 28 are coaxially disposed within the housing 20.

The housing 20 further includes an inlet port 48 for accommodating a fuel and air mixture. The opening of the inlet port 48 communicates with the central passageway 22. Spaced across the central passageway 22 from the inlet port 48, is a second port 50. The opening of the second port 50 communicates with the central passageway 22, and typically accommodates a spark ignition means 52. The spark ignition means 52 has an electrode 54. The spark ignition means 52 is mounted through the second port 50 such that its electrode 54 along with a bracket 58 (to be discussed subsequently) does not substantially extend into the central passageway 22, so as not to interfere with the monitoring of the pilot or main burner flame by the flame detecting means 30. As will be more apparent from the subsequent discussion relating to contacting the electrode 54 to a central conducting wire 56, it is most helpful if the spark ignition means 52 is screwed into an adapter 57 which is fitted into a recess in the housing 20. The adapter is rotatable in the housing 20 and is held in place by the screws 59. As shown in the drawings, the air-fuel mixture inlet port 48 is coaxially disposed with respect to the second port 50, however, such a coaxially disposed arrangement is not necessary in the operation of the pilot flame assembly 10 of the present invention.

Extending through the central passageway 22 is a central conducting wire 56. The central conducting wire 56 is attached at one end to the electrode 54 by utilizing a bracket 58 as shown in detailed FIG. 4. The bracket 58 is screwably mounted to the electrode 54. The end of the electrode 54 in contact with the central conducting wire 56 is typically flat at the point where it contacts the electrode 54, so that the electrode 54 and central conducting wire 56 can more readily be aligned. There is a hole in the bracket 58 through which the wire 56 passes to contact the electrode 54. The electrode 54 and conducting wire 56 in the bracket 58 should not interfere with visual sightings through passageway 22. It is quite understandable that in the operations of screwing the electrode 54 into the bracket 58 for proper alignment and contact with wire 56, there should not be any interference with the set of screw threads on the spark ignition means 52, therefore the reason for the adapter 57. While the spark ignition means 52 is screwed into the adapter 57, the adapter 57 is rotatable in the housing 50 so that alignment and contact between the electrode 54 and wire 56 through bracket 58 is made without interference from the operation of screwing the spark ignition means 52 into the adapter 57. Once the wire 56 and electrode 58 are aligned and in contact, the screws 59 are tightened to prevent rotatable motion of the adapter 57 and spark ignition 52. The other end of the central conducting wire 56 extends through the intermediate opening 35 in the disk-like screen element 36. The end of the central wire 56 spaced from the end which contacts the electrode 54, is bent at right angles away from the central opening 38 toward but never reaching housing element 32. The distance between the bent end of the wire 56 and housing element 32 is the spark gap of the pilot flame assembly 10. The bent end of wire 56 is preferably located between two of the spaced-apart openings 40. Thus, the contacting wire 56 is proximate to the air-fuel mixture flow for easy ignition, but is beneath the hot flame for protection against premature burn-out. Central conducting wire 56 may be covered with suitable insulation to prevent inadvertent sparking and ignition within central passageway 22. It is also anticipated by the present invention that the bent end of the wire 56 may be embedded into a recess in the disk-like screen element 36 to protect against premature burn-out. Also, the end of the conducting wire 56 which is in contact with the electrode has been described as being flattened. The fact that it is flattened prevents rotation of the conducting wire 56 and thus in turn prevents a variation in the spark gap distance.

The housing 20 further includes a third port 60 which is disposed below the first port 26 and typically also disposed below the inlet port 48 and second port 50. The third port 60 does not communicate with the central passageway 22, and the axis of the opening of the third port 60 forms an angle, typically an acute angle, with the longitudinal axis of the central passageway 22.

The purpose of the third port 60 is twofold. First, it may accommodate a screwably mounted and visual clear sight plug 62 so that an operator may look through the sight plug 62 and visually see the pilot flame. Also, the third port 60 provides means for manually igniting the pilot burner. That is, if the sight plug 62 is removed from the third port 60, a torch may be placed through the third port 60 for igniting the pilot flame.

In the operation of the pilot flame assembly 10 of the present invention, an air-fuel mixture will be pumped under pressure to the pilot flame assembly 10 through the inlet port 48. The air-fuel mixture will flow through the central passageway 22, and through the central opening 38 and spaced-apart openings 40 of the disk-like element 36. An electrical current is then applied to the spark ignition means 52. The applied current is transmitted via the electrode 54 of the spark plug 52 to the central conducting wire 56. This applied electrical current causes a spark at the end of the central conducting wire 56 which passes through the disk-like screen element 36, and ignites the air-fuel mixture passing through the central opening 38 and spaced-apart openings 40. The purpose of the spaced-apart openings 40 in the disk-like screen element 36 is to provide a ring of small flames to stabilize the longer reaching flame emanating from the central opening 38. The pilot flame of the pilot flame assembly 10 will, through a lighting hole, ignite the main flame of the furnace burner.

If in the operation of the pilot flame assembly 10, the flame detection means 30 are not to be utilized, then a plug can be screwably mounted to the first port 26.

An advantage of the pilot flame assembly of the present invention, is that the spark ignition means 52 does not visually interfere with the monitoring by the flame detection means 30 of the pilot flame or the main flame of the furnace burner. The flame detection means 30 performs its monitoring function by sighting down central passageway 22, through central opening 38, and detecting the ultraviolet radiation which emanates from a flame.

Therefore, the pilot flame assembly of the present invention provides a pilot flame, but also provides in a single housing, means to accommodate a flame detector means, a spark ignition means, manual ignition means and entry of the desired air-fuel mixture.

I claim:

1. A pilot flame assembly suitable for generating a pilot flame for igniting the main flame of a furnace comprising:

(a) a housing having a central passageway extending longitudinally through said housing, said central passageway having a pilot flame emitting end;

(b) a first port accommodating a semiconductor flame detection means at an end of the central passageway opposite said pilot flame emitting end, the opening of said first port being in communication with the central passageway in a substantially coaxial relationship, said semiconductor flame detection means constructed for detection of the pilot flame or the main furnace flame by sensing the emitted radiation of said flames;

(c) a baffle assembly within said central passageway and coaxially disposed to said first port, said baffle assembly in proximity to the pilot flame emitting end;

(d) an inlet port for accommodating a fuel-air mixture;

(e) a second port accommodating a spark ignition means, the openings of said second port and inlet port communicating with said central passageway; and (f) a third port mating with means for viewing the pilot flame of said pilot assembly, said third port being disposed below said first port, the opening of said third port having an axis which is at an angle with respect to the axis of said central passageway.

2. The pilot assembly in accordance with claim 1, wherein the axis of the opening of said third port intersects with the axis of said first port and said baffle assembly to form an acute angle.

3. The pilot assembly in accordance with claim 2, wherein said third port is further disposed below said second port and said inlet port.

4. The pilot assembly in accordance with claim 1, wherein said housing further comprises a pair of spaced-apart shoulders which extend around the inside of the housing and into said central passageway, said shoulders being in the proximity of the pilot flame emitting end of said housing.

5. The pilot assembly in accordance with claim 4, wherein said baffle assembly is disposed between and adjacent said pair of spaced-apart shoulders.

6. The pilot assembly in accordance with claim 5, wherein said baffle assembly comprises a disk-like screen element substantially adjacent said shoulder closest said pilot flame emitting end, said disk-like screen element having a central opening therethrough, a plurality of spaced-apart openings in the vicinity of the periphery of the disk-like screen element forming a circular-like pattern, with an intermediate opening spaced between said central opening and one or more of said spaced-apart openings; an intermediate element adjacent said disk-like screen element, said intermediate element being substantially cylindrical and hollow in shape; and biasing means adjacent to and between said intermediate element and said shoulder farthest from said pilot flame emitting end.

7. The pilot assembly in accordance with claim 6, wherein said spark ignition means has an electrode.

8. The pilot assembly in accordance with claim 7, wherein said spark ignition means is mounted into an adapter means which is in communication with said second port.

9. The pilot assembly in accordance with claim 8, wherein said adapter means is secured to said housing by a fastening means.

10. The pilot assembly in accordance with claim 7, wherein an electrode from said spark ignition means extends a distance into said central passageway so as not to be capable of interfering with the flame monitoring of said flame detector means.

11. The pilot assembly in accordance with claim 10, wherein a central conducting wire is attached to the electrode of said spark ignition means and said center conducting wire extends through said intermediate opening in said disk-like screen element.

12. The pilot assembly in accordance with claim 11, wherein said electrode is secured into a bracket means and said conducting wire extends through a hole in said bracket means for contacting said electrode.

13. The pilot assembly in accordance with claim 12, wherein said conducting wire is flat where it comes in contact to said electrode to prevent said conducting wire from rotating.

14. The pilot assembly in accordance with claim 11, wherein the end of said conducting wire entering through said intermediate opening is bent at about a right angle away from said central opening of said disk-like screen element and towards said housing.

15. The pilot assembly in accordance with claim 14, wherein the distance from said bent end of said conducting wire to said housing is the spark gap of said assembly.

16. The pilot assembly in accordance with claim 1, wherein said flame detecting means is an ultraviolet radiation semiconductor photodiode.

17. The pilot assembly in accordance with claim 1, wherein a portion of said housing at the pilot flame emitting end is a tubular element screwably mounted to the remaining portion of said housing, and a portion of said baffle assembly extends into said tubular element of said housing.

18. The pilot assembly in accordance with claim 1, wherein a visually clear sight plug is screwably mounted to said third port.

19. The pilot assembly in accordance with claim 1, wherein the axis of said second port and said air-fuel mixture inlet port are coaxially disposed.

20. In a pilot flame assembly having a housing, a central passageway extending longitudinally through said housing, a pilot emitting end at one end of said central passageway, and a pair of spaced-apart shoulders which extend around the inside of the housing and into said central passageway, said shoulders being in the proximity of the pilot flame emitting end of said housing, the improvement comprising:

a baffle assembly having a disk-like screen element substantially adjacent said shoulders closest said pilot flame emitting end, said disk-like screen element having a central opening therethrough, a plurality of spaced-apart openings in the vicinity of the periphery of the disk-like screen element forming a circular-like pattern, with an intermediate opening spaced between said central opening and one or more of said spaced-apart openings;

an intermediate element adjacent said disk-like screen element, said intermediate element being substantially cylindrical and hollow in shape;

an annular cavity recessed in the end of said intermediate element abutting said disk-like screen element, the outer wall of said annular cavity extending greater than the inner wall of said cavity such that only said outer wall is adjacent to said disk-like screen element, with a gap between said inner wall and said disk-like screen element; and a biasing element adjacent to and between said intermediate element and said shoulder farthest from said pilot flame emitting end so as to retain said outer wall in contact with said disk-like screen element and maintain substantially constant the gap between said inner wall and said disk-like screen element.

21. The pilot assembly in accordance with claim 20, wherein said biasing element is a spring.

22. The pilot flame assembly in accordance with claim 1, wherein the axes of said inlet port and said second port are substantially perpendicular to the axes of said first port and baffle assembly, with the openings of said second port and said inlet port communicating in a substantially perpendicular orientation to said central passageway.

23. A pilot flame assembly suitable for generating a pilot flame for igniting the main flame of a furnace comprising:

(a) a housing having a central passageway extending longitudinally through said housing, said central passageway having a pilot flame emitting end;

(b) a first port accommodating a semiconductor flame detection means at an end of the central passageway opposite said pilot flame emitting end, the opening of said first port being in communication with the central passageway in a substantially coaxial relationship, said semiconductor flame detector means constructed for detection of the pilot flame or the main furnace flame by sensing the emitted radiation of said flames;

(c) an inlet port for accommodating a fuel-air mixture, the opening of said inlet port communicating with said central passageway;

(d) a baffle assembly within said passageway and coaxially disposed to said first port, said baffle assembly in proximity to the pilot flame emitting end, said baffle assembly having a disk-like screen element with a plurality of openings therethrough to accommodate an fuel-air mixture flowing through said central passageway, an intermediate element substantially hollow in construction and a biasing means for maintaining said intermediate element adjacent said disk-like screen element;

(e) a second port accommodating a spark ignition means, the opening of said second port communicating with said central passageway;

(f) a third port mating with means for viewing the pilot flame of said pilot assembly, said third port being disposed below said first port, the opening of said third port having an axis which is at an angle with respect to the axis of said central passageway.

24. The pilot flame assembly in accordance with claim 23, wherein said biasing means is a spring.

* * * * *